US005884568A

United States Patent [19]

Dombroski

[11] Patent Number: 5,884,568

[45] Date of Patent: Mar. 23, 1999

[54] ENCLOSED UTILITY TABLE

[76] Inventor: Edward L. Dombroski, 16 Catskill Ave., Poughkeepsie, N.Y. 12603

[21] Appl. No.: 821,908

[22] Filed: Mar. 21, 1997

[51] Int. Cl.[6] ..... A47B 3/06

[52] U.S. Cl. ..... 108/153.1; 108/42; 108/180; 108/189; 108/193

[58] Field of Search ..... 135/95, 96, 119, 135/128, 161; 108/180, 189, 193, 182, 157.16, 158.12, 153.1, 157.14, 42

[56] References Cited

U.S. PATENT DOCUMENTS

| | | | |
|---|---|---|---|
| 356,015 | 1/1887 | Steinberg | 135/161 X |
| 2,110,718 | 3/1938 | Shiley | 108/157.16 |
| 2,711,783 | 6/1955 | Prill | 108/42 X |
| 3,233,618 | 2/1966 | Ferrier | 108/42 |
| 3,307,565 | 3/1967 | Luccarelli | 108/42 |
| 3,451,361 | 6/1969 | Sorenson | 108/180 X |
| 3,887,207 | 6/1975 | Gotsch, Jr. | 108/189 X |
| 4,191,113 | 3/1980 | Hogberg | 108/157.16 |
| 4,478,428 | 10/1984 | Ziliani | 108/189 X |
| 4,986,505 | 1/1991 | Zabawski et al. . | |

FOREIGN PATENT DOCUMENTS

| | | | |
|---|---|---|---|
| 852492 | 2/1940 | France | 135/96 |
| 3221169 | 1/1983 | Germany | 108/42 |
| 686103 | 3/1965 | Italy | 108/180 |

*Primary Examiner*—Jose V. Chen
*Assistant Examiner*—Hanh V. Tran
*Attorney, Agent, or Firm*—Edwin Lester

[57] ABSTRACT

An improved enclosed multi-purpose utility table adaptable for mounting on a horizontal fence railing or for resting on a floor surface or wheelable on a floor surface. The table includes a rectangular base member with a pair of stationary secured end plates. A pair of bars are inserted in corresponding upper corner openings of the end plates and a cover sheet is mounted over the bars and end plates with the bottom ends of the sheet extending to the base member sides to allow each side of the cover sheet to be independently opened and closed. The bottom ends of the cover sheet are weighted and may be fitted into corresponding lower corner openings of the end plates when it is desired to maintain the cover sheet closed, flat and wrinkle free on either or both sides. A third bar is provided on the cover sheet, centered between the first and second bars with locking structure overlapping the three bars for maintaining the cover sheet in a fixed position to prevent any shifting of the cover sheet when it is opened on either or both sides of the table. The locking structure together with the overlapped three bars form a cradle to support either or both sides of the cover sheet when either or both sides are opened for access to the interior of the table. Various alternative leg support structure are provided on the backside of the base member. In one instance, where it is desired to mount the table on a fence railing, the leg supports are wrapped tightly to the vertical members of the railing to prevent the base member from tilting and multiple structure are provided on the underside of the base member to sandwich it to the top of the railing to prevent lateral sliding. In another instance, the leg supports are provided with stabilizing structure to allow the table to be free standing on a floor surface. In further instance, one of the leg supports can be provided with wheels and hand bar structure connected to the underside of the base member to allow for a hand held easily movable table on a floor surface.

8 Claims, 8 Drawing Sheets

ENCLOSED UTILITY TABLE

BACKGROUND OF THE INVENTION

The present invention relates to tables, and more particularly, to an enclosed table adapted for a variety of purposes. The table may be adapted for mounting on the horizontal top railing of an outdoor fence or may be arranged to be free standing on a floor surface or may be provided with wheel and hand bar means to permit easy movement of the table on a floor surface. The variety of purposes to which the table may be used is enhanced by a unique cover design and an enhanced load supporting capability. The cover can be opened from both sides and thereby may be used buffet style for lawn parties and when used on floor surfaces may be moved about as might be required by caterers. It can also be used as a terrarium and would be useful in quantity by nurseries because of its mobility. When mounted on a fence railing it can be used for patio parties and family cookouts and because of its easily operated cover it can protect from insects or the elements. Whether rail attached or free standing it can provide a separate area for beverages, juices, cups, salads, desserts etc.

A type of enclosed utility table known in the prior art is U.S. Pat. No. 4,986,505, which issued to joint inventors S. M. Zabawski and the present applicant, E. L. Dombroski. The enclosed patio table disclosed in this patent provides a table for mounting on the horizontal top railing of an outdoor fence but has no provision for allowing it to be free standing or moveable on a floor surface as is the case in the present invention.

Additionally, the Zabawski et al patent discloses a utility table with a cover enclosure composed of rigid plates connected to a rigid side plate which may be formed from glass like material whereas the enclosed utility table of the present invention provides a light weight cover sheet which is not fixed to a side of the table but instead a cradle like locking arrangement is provided for maintaining the cover sheet in a fixed position.

Further, the cover enclosure of the Zabawski et al patent is limited to being opened only on one side whereas the arrangement of the present invention permits the cover sheet to be opened on either or both sides of the table.

Still further, one side of the cover enclosure of the Zabawski et al patent when fully opened is placed against the other side of the cover enclosure thereby precluding the ability to open the other side of the cover enclosure whereas the cradle like arrangement of the present invention which maintains the cover sheet in a fixed position is used to support either or both sides of the cover sheet when either or both sides are opened for ready access to the interior of the table.

Even further, the frame of the Zabawski et al patent provides a complex clamping mechanism which includes clamping brackets slidably mounted on threaded rods for maintaing the table engaged with a horizontal fence railing whereas the present invention simply provides a series of peg supports on the underside of the table for maintaining the table engaged with the horizontal fence railing. The table of the present invention includes leg supports with simple wrap means for wrapping the leg supports against the vertical members of the railing to prevent tilting of the table. Such an arrangement is neither shown nor disclosed in the Zabawski et al patent.

Another advantage of the present invention not found in the prior art is the provision of weighted means attached to the bottom ends of the cover sheet which when placed in corresponding corner openings of the end plates of the table maintains the cover sheet closed, flat and wrinkle free and when removed from the openings allows the cover sheet to be opened on either side of the table for ready access to the interior of the table.

Accordingly, it is an object of the invention to provide a new and improved multi-purpose utility table.

Another object of the invention is to provide a new and improved enclosed utility table which may be mounted on a horizontal fence railing or may be adapted for resting or wheelably moveable on a floor surface.

Still another object of the invention is to provide a new and improved enclosed utility table which uses a cradle like arrangement for maintaining the enclosure sheet in a fixed position.

A further object of the invention is to provide a new and improved enclosed utility table in which the enclosure sheet may be opened on either or both sides of the table.

Still a further object of the invention is to provide a new and improved enclosed utility table for mounting on top of a fence railing with simplified means to prevent lateral sliding of the table.

An even further object of the invention is to provide a new and improved enclosed utility table for mounting on a fence railing with leg means tightly wrapped to the vertical members of the railing to prevent the table from tilting.

SUMMARY OF THE INVENTION

In view of the foregoing advantages, the present invention provides a new and improved enclosed utility table neither shown nor disclosed in the prior art. The table consists of a rectangular base member with plates secured at each end. The end plates have corresponding upper and lower corner openings with a first pair of bars inserted in the corresponding upper corner openings. A cover sheet is mounted over the bars and end plates with the bottom ends of the sheet extending to the base member sides. The bottom ends of the cover sheet are weighted and they may be fitted into the corresponding lower corner openings when it is desired to maintain the cover sheet closed to protect against insects or the elements. Another bar is placed on the cover sheet centered between the first pair of bars with locking means overlapping the bars for maintaining the cover sheet in a fixed position. The locking means together with the overlapped bars form a cradle to support the cover sheet when either or both sides are opened for access to the interior of the table. when it is desired to mount the table on a fence railing, multiple peg means are provided on the table underside to prevent lateral sliding of the table and leg means also provided on the table underside are tightly wrapped together against the vertical members of the railing to prevent tilting of the table. When it is desired to have the table free standing on a floor surface, other leg support means are provided with stabilizing means to allow the table to be free standing. Further, when it is desired to have the table freely moveable on a floor surface, one of the leg support means is provided with wheels to allow the table to operate as a mobile table and a hand bar means is connected at the underside of the table to allow hand held movement of the wheeled table.

The foregoing and other objects, features and advantages of the invention will be apparent from the following particular description of a preferred embodiment of the invention, as illustrated in the accompanying drawings.

DETAILED DESCRIPTION OF THE INVENTION

Figure 1:
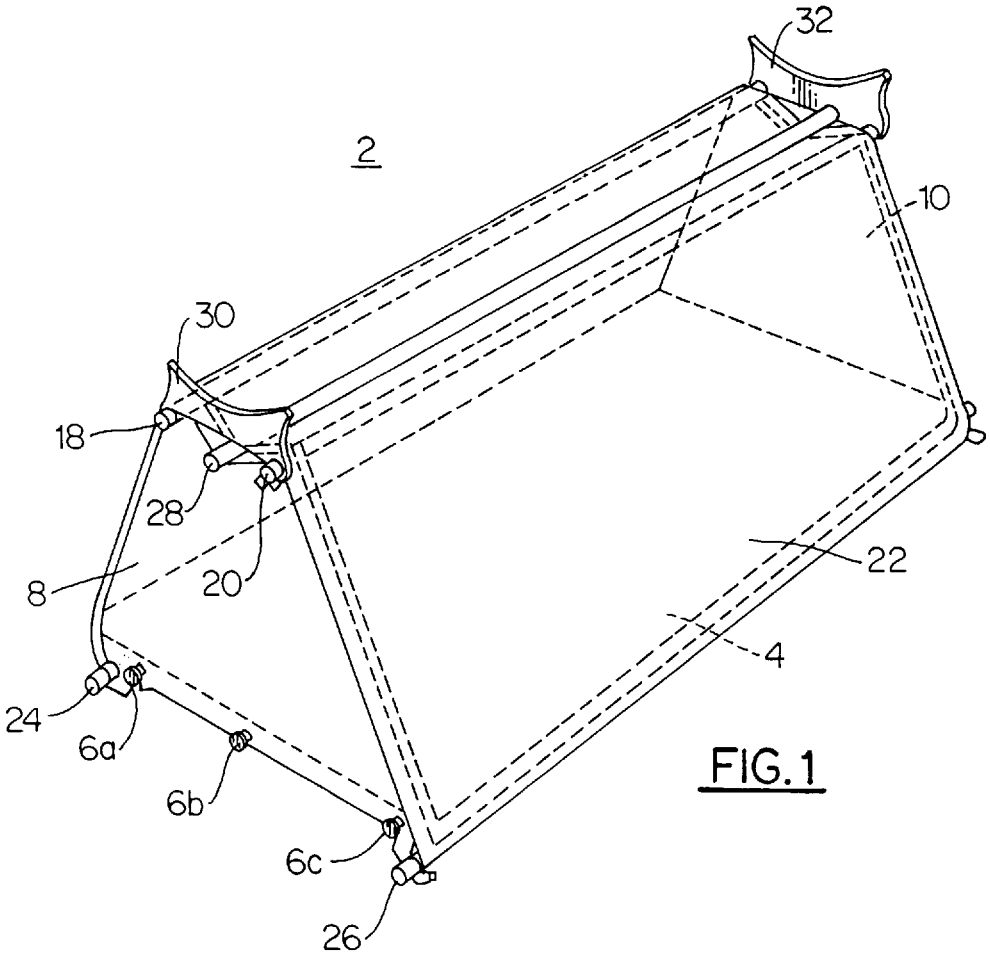
FIG. 1 is a perspective view illustrating the enclosed utility table of the present invention.

With reference now to the drawings, and in particular to FIG. 1 thereof, there is shown a new and improved enclosed utility table of the present invention and generally designated by the reference numeral 2.

More particularly, the enclosed utility table 2 of the present invention includes an elongated generally rectangular shelf or base member 4 which may be a solid wood board, a melamine board or several varied plastic equivalents. Included at each end of the base member 4 are three protruding studs 6*a*, 6*b* and 6*c* which are used to permit mounting of two end plates 8 and 10.

Figure 2:
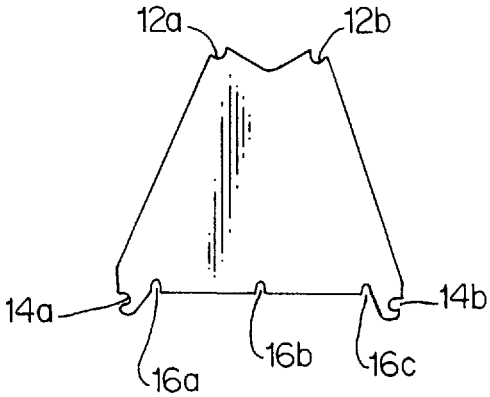
FIG. 2 is an end view of an end plate of the enclosed utility table.

FIG. 2 is an end view of the end plate 8 and includes two upper openings 12*a* and 12*b* which are used to support mounting tubes, two lower openings 14*a* and 14*b* which are used to support weighted tubes and three mounting slotes 16*a*, 16*b* and 16*c* which are used to fit over the protruding studs 6*a*, 6*b* and 6*c* at the end portion of the shelf 4. A similar arrangement is provided for the end plate 10.

Referring again to FIG. 1, after the end plates 8 and 10 are mounted on the protruding studs 6*a*, 6*b* and 6*c* of the shelf 4, mounting bars 18 and 20, which may be tubular in shape, are snapped into corresponding upper openings 12*a* and 12*b* of the end plates 8 and 10 After the mounting bars 18 and 20 are positioned on the end plates 8 and 10 there is approximately one inch of the tubes protruding outwardly from each end of the end plates 8 and 10. The cover sheet 22 is preferably comprised of a thin, clear plastic sheet with weighted tubes 24 and 26 attached to each end of the bottom ends of the cover sheet 22. As seen in FIG. 1, the cover sheet 22 overlaps each of the end plates 8 and 10 and extends down to the sides of the base member 4. With this arrangement, the bottom ends of the cover sheet 22 may be allowed to move between open and closed positions.

In, the closed position, each of the weighted tubes 24 and 26 attached to the bottom ends of the cover sheet 22 may be nested in the lower corner openings 14*a* and 14*b* of the respective end plates 8 and 10. This anchors the cover sheet 22 and with the mounting tubes 13 and 20, the edges of the end plates 8 and 10 and the sides of the base member 4 being in a single plane maintains the cover sheet on both sides closed, flat and wrinkle free. In this close position, it also protects the interior of the table 2 from insects or the outdoor elements. When either or both of the weighted tubes 24 and 26 are removed from the lower corner openings 14*a* and 14*b* of the end plates 8 and 10, the cover sheet 22 may be opened from either or both sides of the utility table 4 for ready access to the interior of the table 2.

Figure 3:
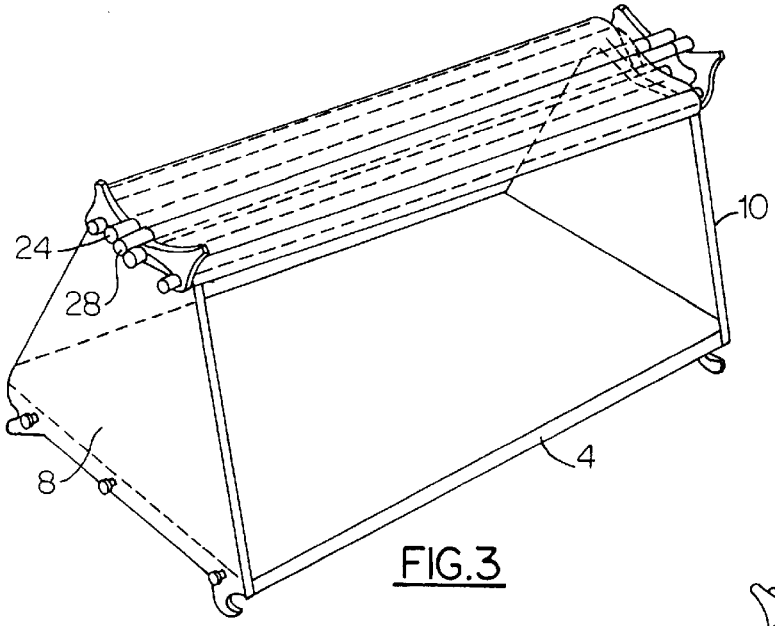
FIG. 3 is a perspective view illustrating the cover sheet of the utility table being cradled on the top portion of the table.

A locking tube 28 is provided on top of the cover sheet 22 centered between the mounting bars 18 and 20 with approximately one inch of the tube protruding from each end of the end plates 8 and 10. A pair of cover anchor plates 30 and 32 are positioned over the protruding ends of the locking tube 28 and the mounting bars 18 and 20 to lock the cover sheet 22, end plates 8 and 10 and base member 4 in a fixed relationship. The shape of the anchor plates 30 and 32 are such as to form a cradle arrangement so that when either or both sides of the cover sheet 22 is opened they may be rolled up and positioned in the cradle area of the utility table 2 as shown in FIG. 3.

Figure 4:
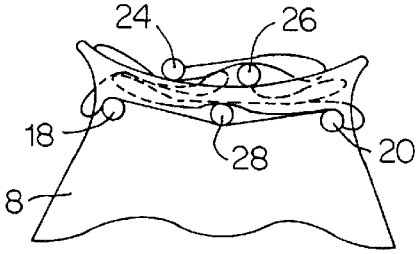
FIG. 4 is a partial end view of and end plate illustrating the cover sheet being cradled on the top portion of the end table.

FIG. 4 is an end view of the end plate 8 illustrating how the weighted bottom ends 24 and 26 together with both sides of the cover sheet can be randomly laid in the cradle area of the utility table 2.

Figure 5:
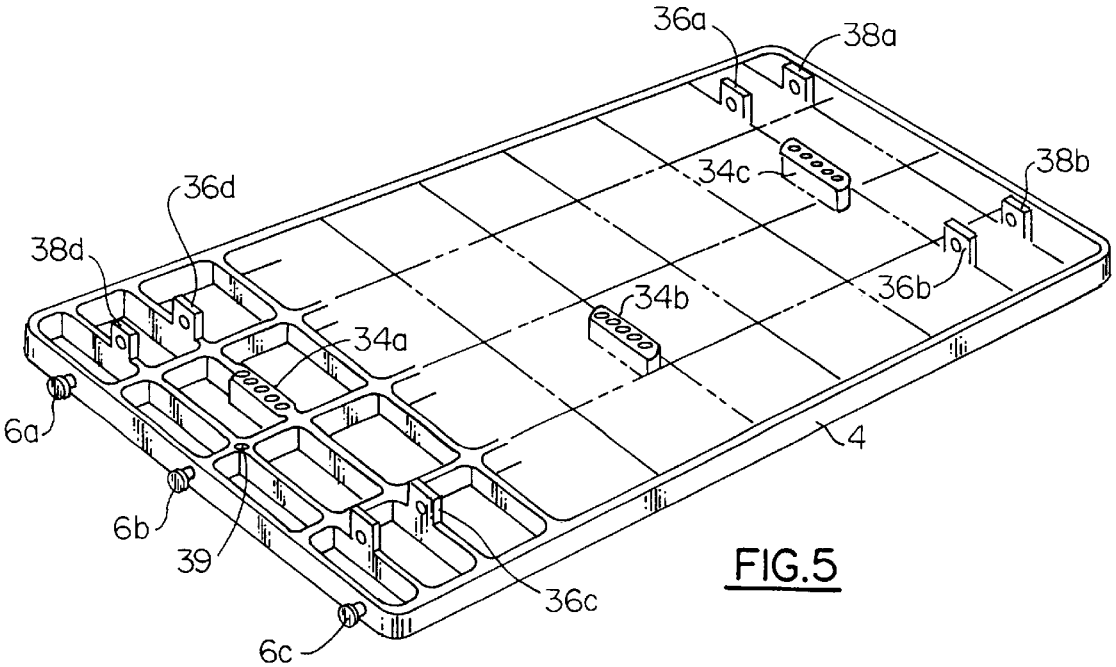
FIG. 5 is a perspective view illustrating the underside of the base member of the utility table.

FIG. 5 illustrates the underside of the base member 4 of the utility table 2. Included on the underside of the base member 4 are a variety of fixtures that are used in various ways depending upon the use which is to be made of the table 2 i.e. whether it is to be mounted on a horizontal top railing of an outdoor fence, whether it is to be free standing on a floor surface or whether it is to be wheeled on a floor surface by hand held means. Studs 6*a*, 6*b* and 6*c* and a corresponding set on the other side of the base member 4 are used to support the end plates 8 and 10 of the table 2.

When the base member 4 of table 2 is to be mounted on a horizontal top railing of a fencer the stud supports 34*a*, 34*b* and 34*c* on the underside of the base member 4 are used to provide support for a series of knurled studs which are pressed against the top railing of the fence to prevent lateral sliding of the table as will be more fully described in connection with FIG. 6. In addition to the stud supports 34*a*, 34*b* and 34*c* there is provided a series of pivot sockets 36*a*, 36*b*, 36*c* and 36*d* for supporting a pair of mounting bars which are wrapped to the vertical members of the railing to prevent tilting of the table 2 as will be more fully described in connection with FIGS. 7, 8 and 9.

When the base member 4 of the table 2 is to be used for free standing or wheeled on a floor surface, there is provided an additional series of sockets 38*a*, 38*b*, 38*c* and 38*d* which together with the corresponding sockets 36*a*, 36*b*, 36*c* and 36*d* provide support for a pair of leg supports which maintain the table free standing on a floor surface. In addition to the sockets 38 for the leg supports there is also provided a tapped hole 39 which will receive one end of a stabilizing bar retained by a threaded stud for stabilizing the free standing position of the table 2 as will be more fully described in connection with the FIGS. 13–16.

Figure 6:
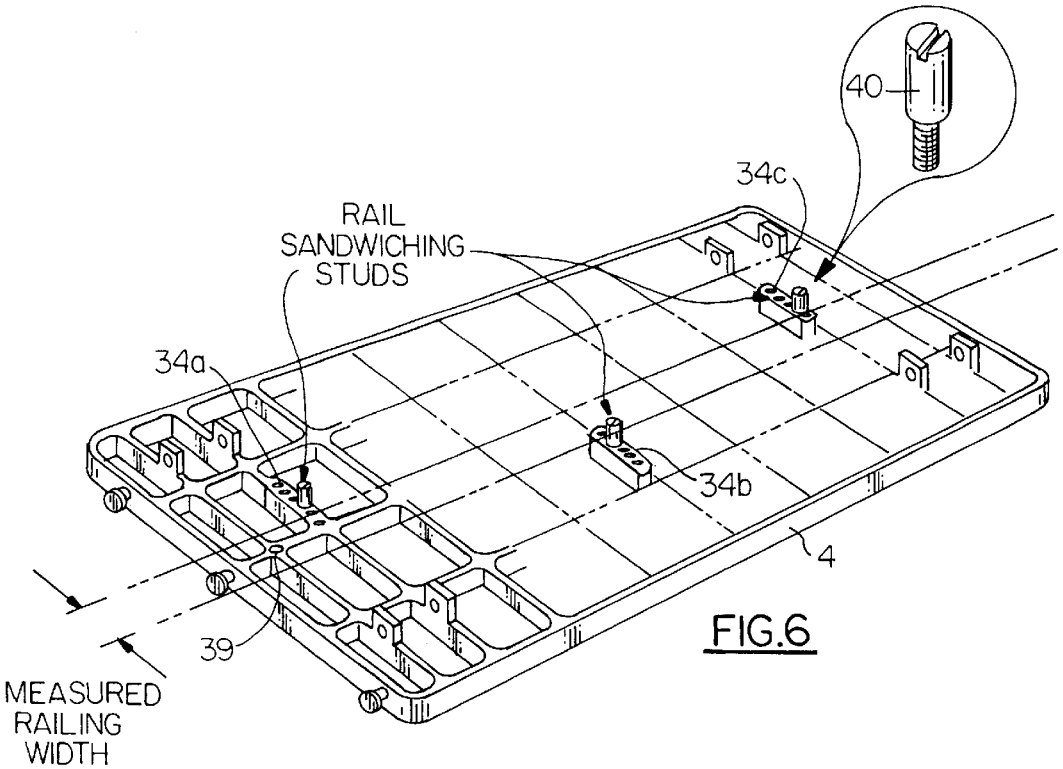
FIG. 6 is a perspective view illustrating the manner in which the base member is attached to the top railing of an outdoor fence.

Referring now to FIG. 6 there is illustrated the manner in which the base member 4 of the table 2 is attached to the top railing of an outdoor fence as viewed from the underside of the railing and base member 4. The first group of elements to be used on the underside of the base member 4 are the three stud supports 34*a*, 34*b* and 34*c* each of which consists of a series of tapped holes to receive a threaded stud such as stud 40. The particular hole chosen in each of the stud supports 34*a*, 34*b* and 34*c* for receiving a threaded stud depends on the thickness of the railing to which the table is to be attached. Thus, the width of the fence railing is measured and to that is added the width of the threaded stud 40 so that the three studs may be threaded into the appropriate tapped holes of the three stud supports to effectively sandwich the base member 4 to the fence railing to prevent the lateral sliding of the table.

Figure 7:
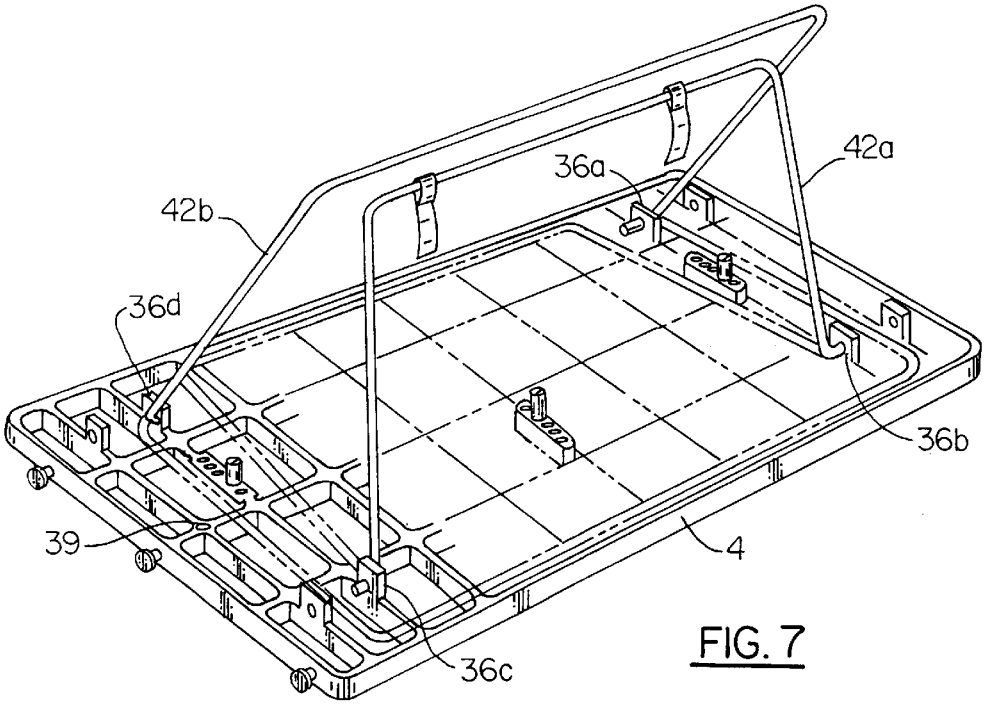
FIG. 7 is a perspective view illustrating one form of leg support connection on the underside of the base member of the utility table.
Figure 8:
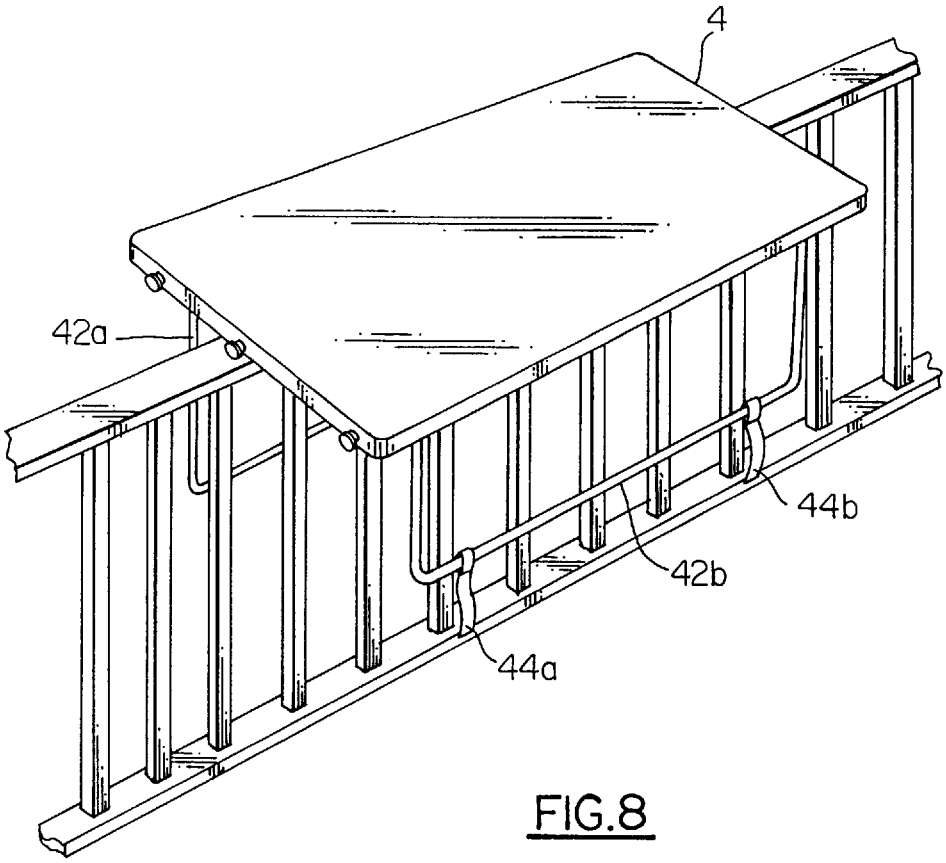
FIG. 8 is a perspective view illustrating the base member of the utility table mounted on a fence railing.
Figure 9:
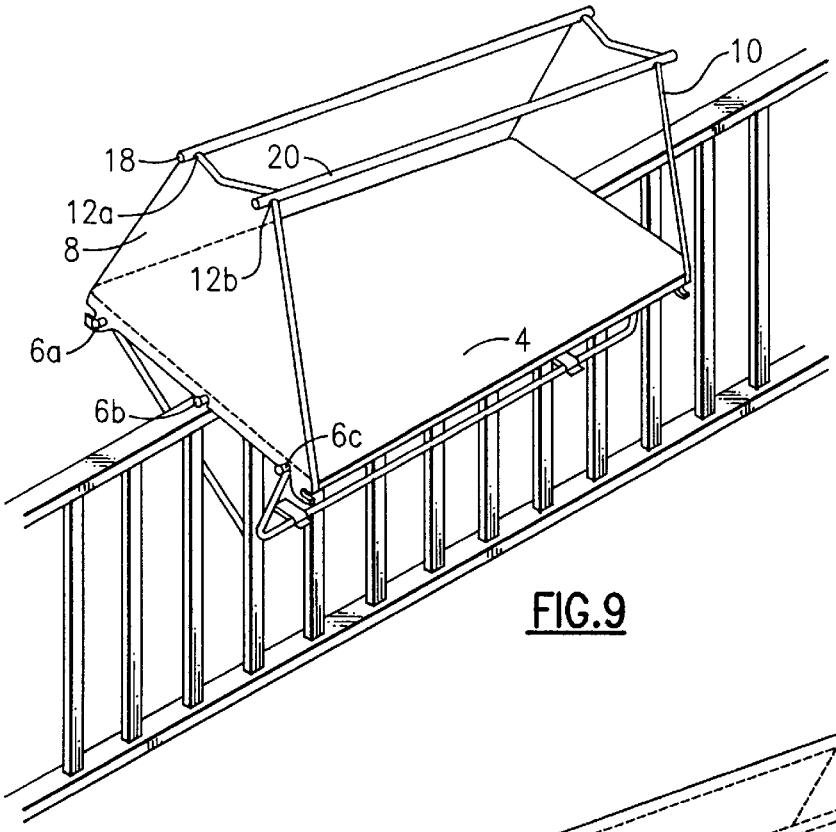
FIG. 9 is a perspective view illustrating a partially constructed utility table mounted on a fence railing with leg supports tightly sandwiching the vertical members of the fence.

Referring now to FIG. 7, there is illustrated the manner in which mounting bars 42*a* and 42*b* may be connected to the underside of the base member 4. The ends of the mounting bar 42*a* may be sprung into sockets 36*b* and 36*c* while the ends of the mounting bar 42*b* may be sprung into sockets 36*a* and 36*d*. The mounting bars 42*a* and 42*b* may initially be stored in a single plane against the shelf 4 and when it is desired that they be used for mounting on the fence railing they are rotated to an open position and the shelf 4 together with the mounting bars 42*a* and 42*b* may now be positioned on the fence railing as shown in FIG. 8. Included on mounting bar 42*b* are two straps 44*a* and 44*b* which may be adhesive type straps made of velcro or its equivalent. These straps are used to tightly pull the mounting bars 42*a* and 42*b* together against the vertical members of the fence railing as shown in FIG. 9. This tight holding of the mounting bars 42*a* and 42*b* prevents the shelf 4 from tilting on the fence railing.

Figure 10:
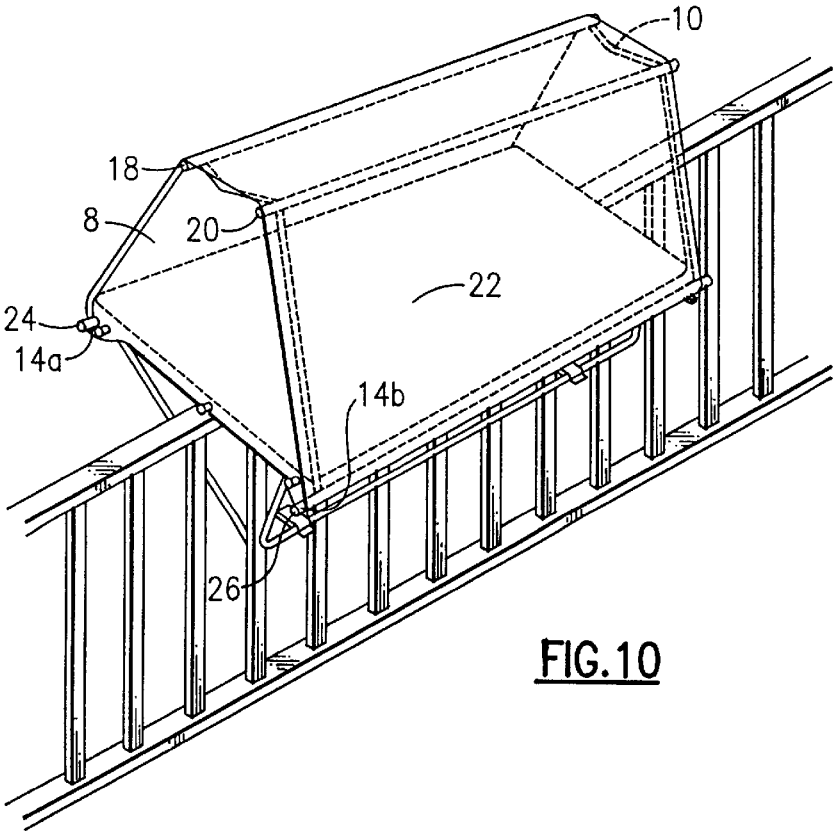
FIG. 10 is a perspective view illustrating the installation of a cover sheet over the end plates of the utility table.

Referring to FIG. 9, with the shelf 4 now in place on the fence railing, the rest of the table 2 may now be assembled. Thus, the end plates 8 and 10 may be mounted on the protruding studs 6*a*, 6*b* and 6*c* of the shelf 4 and the mounting bars 18 and 20 snapped into the corresponding upper openings 12*a* and 12*b* of the end plates 8 and 10 with approximately one inch of the bars protruding from each of the end plates 8 and 10. In FIG. 10, the cover sheet 22 is then centered over the mounting bars 18 and 20 and the end plates 8 and 10 extending down to the sides of the shelf 4. The weighted tubes 24 and 26 attached to the bottom ends of the cover sheet 22 are then nested into the lower corner openings 14*a* and 14*b* of the respective end plates 8 and 10. In this position, the cover sheet 22 is anchored to the table2 and is maintained in a closed position.

Figure 11:
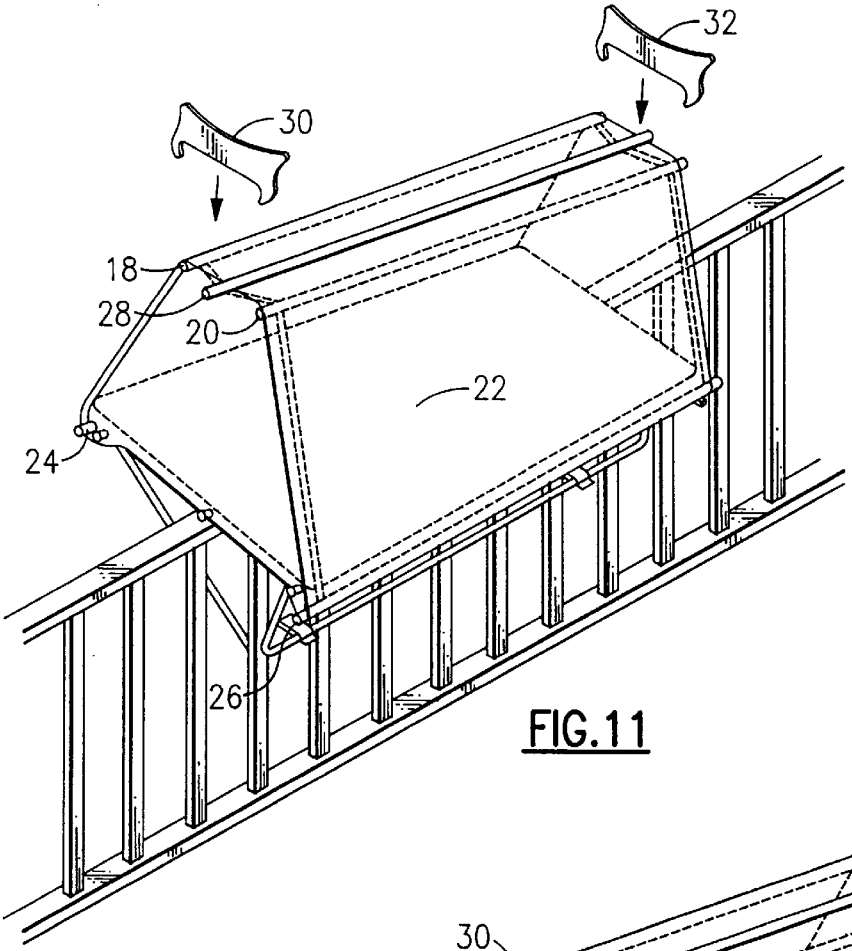
FIG. 11 is a perspective view illustrating how the anchor plates used to clamp the cover sheet in fixed position on top of the utility table.
Figure 12:
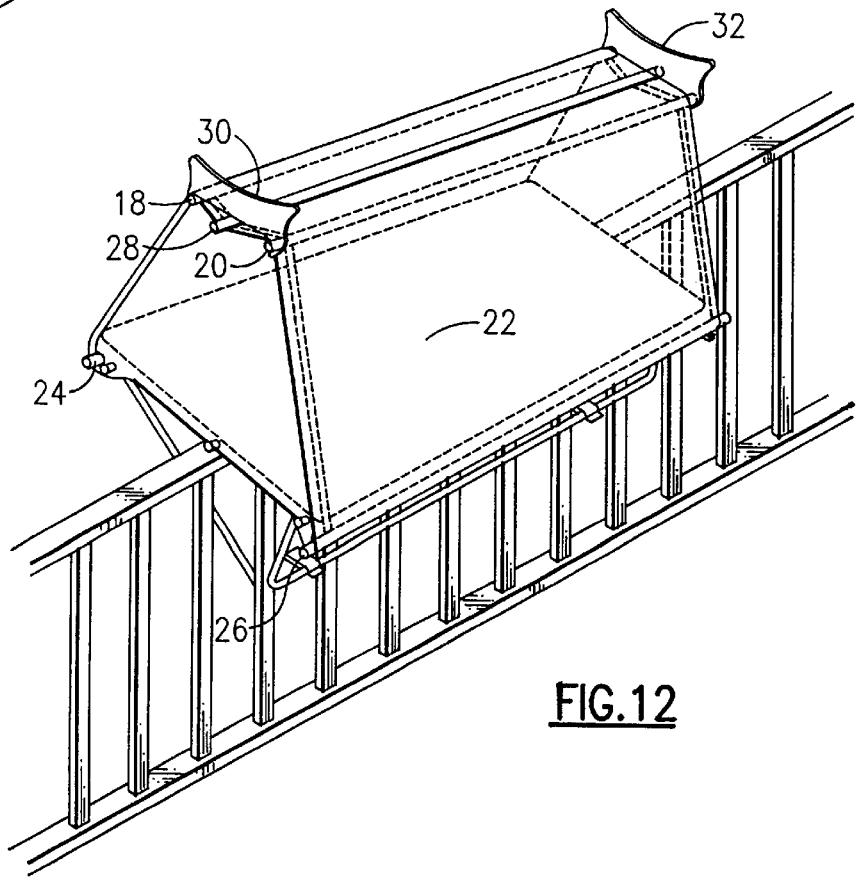
FIG. 12 a perspective view illustrating the anchor plates in their final position on top of the utility table.

Referring now to FIGS. 11 and 12, there is illustrated a locking tube 28 provided on top of the cover sheet and centered between the mounting bars 18 and 20 with approximately one inch of the tube protruding from each end of the end plates 8 and 10 as in the cae of the mounting bars 18 and 20. A pair of cover anchor plates 30 and 32 are provided, as shown in FIG. 11, which are placed over the protruding ends of the locking tube 28 and pushed down until they snap onto the protruding ends of the mounting bars 18 and 20. This movement of the anchor plates 30 and 32 also forces the locking tube 28 down onto the top of the end plates 8 and 10 to lock the cover sheet 22, end plates 8 and 10 and shelf 4 in a fixed relationship as shown in FIG. 12. With the weighted ends of the cover sheet 22 nested into the lower corner openings of the end plates 8 and 10, the cover sheet 22 is maintained in a closed, flat and wrinkle free position and protects the interior of the table 2 from insects or the outdoor elements. It should be noted that the shape of the anchor plates 30 and 32 are such as to form a cradle arrangement so that when either or both sides of the cover sheet 22 are opened they may be rolled up and positioned in the cradle area of the utility table 2 as shown in FIGS. 3 and 4. Further, it should be noted that when either or both of the weighted tubes 24 and 26 are removed from the lower corner openings 14*a* and 14*b* of the end plates 8 and 10, the cover sheet 22 may be readily opened from either or both sides for ready access to the interior of the table 2.

Figure 13:
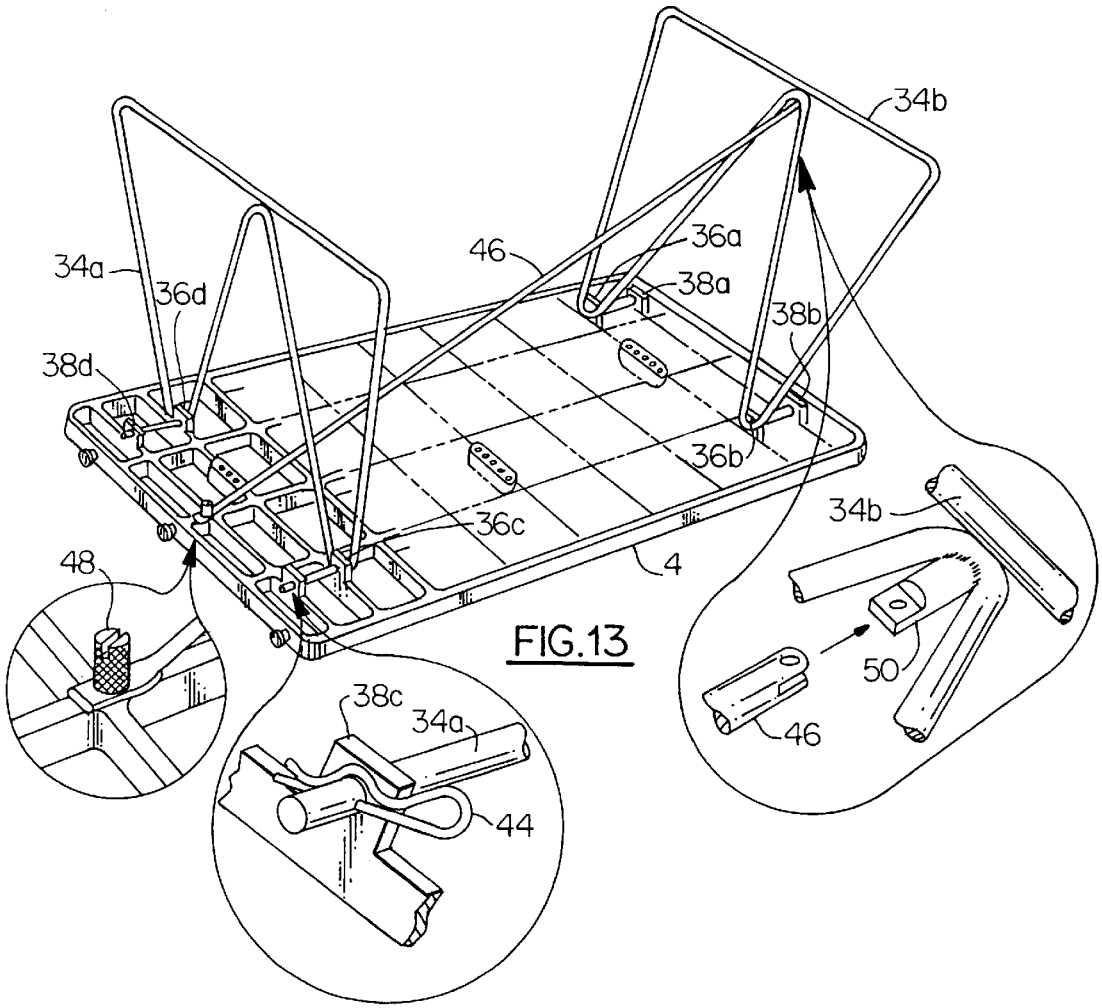
FIG. 13 is a perspective view illustrating another form of leg support connection on the underside of the base member of the utility table.
Figure 14:
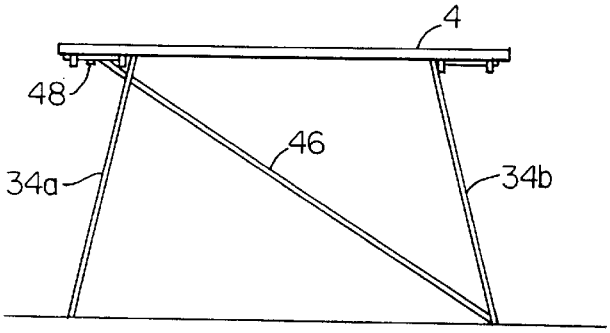
FIG. 14 is a side elevation view illustrating the base member of the utility table being free standing on a floor surface.

Referring now to FIG. 13, there is illustrated how the shelf 4 may be set up to be free standing on a floor surface as shown in FIG. 14. FIG. 13 discloses the series of additional sockets 38*a*, 38*b*, 38*c* and 38*d* which together with corresponding sockets 36*a*, 36*b*, 36*c* and 36*d* provide support for legs 34*a* and 34*b*, the lower ends of which are placed through corresponding pair of sockets e.g. through sockets 36*c* and 38*c*. An enlarged view of the socket 38*c* shows a locking pin 44 that prevents the ends of the leg 34*a* from slipping out of the socket 38*c*. A similar arrangement is provided at each of the other corners of the leg supports 34*a* and 34*b*. A stabilizing bar 46 is connected between one end of the shelf 4 and the lower end of the leg support 34*b*. An enlarged view of the stud 484 is shown screwed through one end of the stabilizing bar 42 into the tapped hole in shelf 4 to hold that end of the stabilizing bar 42 steady while the other end of the stabilizing bar 46 is meshed with an abutment 50 of the leg support 34*b*. A locking pin, similar to locking pin 44, is secured through the holes in the stabilizing bar 46 and the abutment 50 of the leg support 34*b* to hold that end of the stabilizing bar 42 steady.

Referring now to FIG. 14, with the stabilizing bar 46 now in place, the shelf 4 together with its leg supports 34*a* and 34*b* may now be turned over and the table 2 assembled upon the shelf 4 in a manner as previously described with respect to FIGS. 9–12 to provide a stable free standing table on a floor surface with the access to the interior of table 2 from either or both sides.

Figure 15:
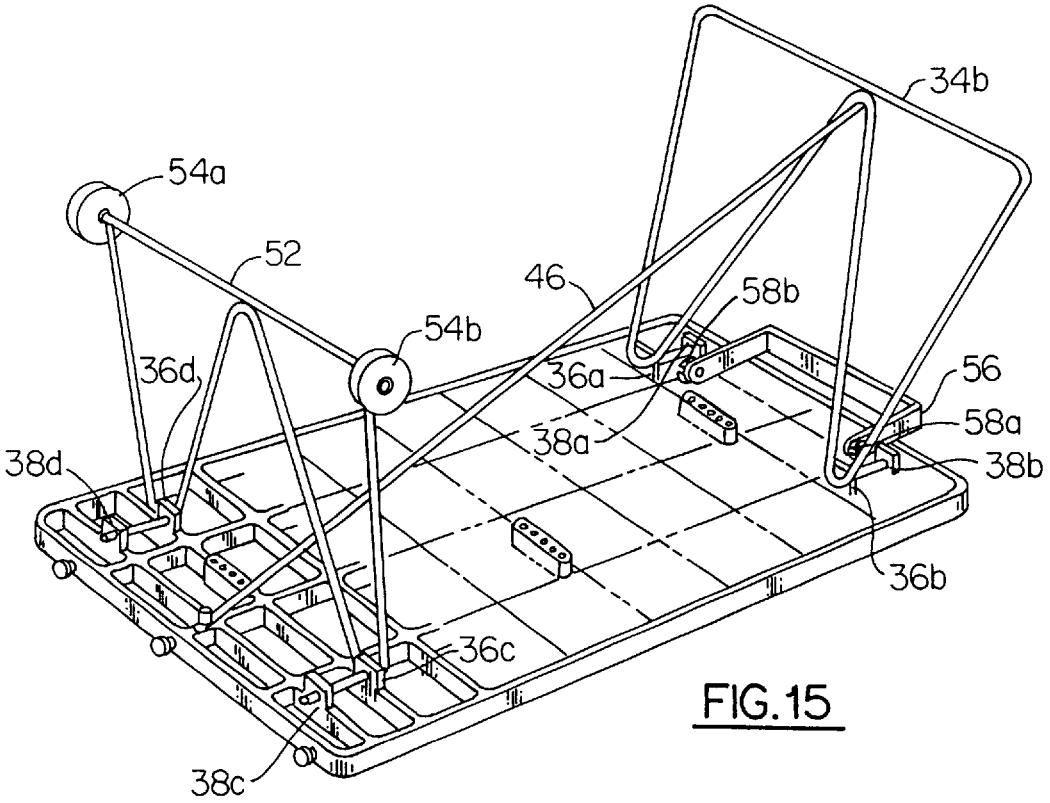
FIG. 15 is a perspective view illustrating wheel connections to a leg support of the utility table together with a hand bar allowing for hand held movement of a wheeled utility table.
Figure 16:
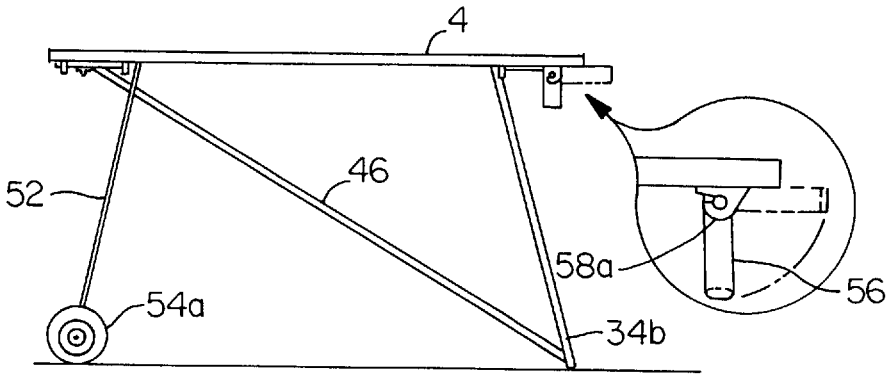
FIG. 16 is a side elevation view illustrating the hand held version of a wheeled utility table.

Referring now to FIG. 15, there is illustrated how the shelf 4 may be set up to be hand wheeled on a floor surface as shown in FIG. 16. In this case, leg support 34*a* shown in FIG. 13 is replaced with leg support 52 which has a pair of wheels 54*a* and 54*b* attached at the ends of the lower part of the leg support 52. Additionally, there is provided a U shaped handle bar 56, adjacent the leg support 34*b*, which has two pins at the outer ends thereof set into two bar supports 58*a* and 58*b*. The handle bar 56 is rotatable from a vertical to a horizontal position parallel with and extending out from the shelf 4 as shown in greater detail in FIG. 16. Therefore, when the table 2 is to be hand movable, the user need only rotate the handle bar 56 upward and lock it into position in the bar supports 58*a* and 58*b*. The leg supports 34*b* and 52 are mounted in a similar manner as that previously described in connection with FIG. 13 i.e. the lower ends; of the leg support 34*b* are placed through the corresponding pairs of sockets 36*a*,38*a* and 36*b*,38*b* while the lower ends of the leg support 52 are placed through the corresponding pairs of sockets 36*c*,38*c* and 36*d*,38*d*. Each of the ends of the leg supports 34*b* and 52 are provided with locking pins in a similar manner as shown in the enlarged view in FIG. 13 to prevent the ends of the leg supports 34*b* and 52 from slipping out of their support sockets. No change need be made to the other leg 34*b* nor to the stabilizing bar 46.

Referring now to FIG. 16, the shelf 4 together with the leg supports 34*b* and 52 may now be turned over onto the floor surface and the table 2 may be easily assembled upon the shelf 4 as previously described in connection with FIGS. 9–12. With this arrangement, the table 2 may easily be wheeled about by a user along a floor surface.

While the present invention has been described in a preferred form, it will be readily apparent that many modifications, additions and deletions may be made therein without departing from the spirit and scope of the invention as set forth in the following claims.

I claim:

1. An enclosed multi purpose utility table comprising:

an elongated rectangular base member having parallel sides and parallel ends, a pair of parallel stationary end plates secured to the parallel ends of said base member having corresponding first and second upper corner openings, a first support member corresponding to one side of said base member being maintained in said corresponding first upper corner openings of said end plates, a second support member corresponding to the other side of said base member being maintained in said corresponding second upper corner openings of said end plates, said support members protruding outwardly and extending a predetermined distance from each of said end plates, a cover sheet centered over said support members and overlapping said end plates having bottom ends thereof extending to the parallel sides of said base member and operable for movement between open and closed positions, a third support member positioned on said cover sheet and centered between said first and second support members, said third support member protruding outwardly and extending a predetermined distance from each of said end plates, and a pair of locking means each positioned on the outwardly extending portions of said first, second and third support members to maintain said cover sheet in a fixed position thereby allowing said cover sheet to be opened on either or both sides without any shifting of said cover sheet.

2. A utility table according to claim 1 in which said support means together with said locking means form a cradle to support said cover sheet when said cover sheet is opened for access to the interior of said table.

3. A utility table accoring to claim 1 in which said support members are tubular shaped.

4. A utility table according to claim 1 in which said end plates have corresponding first and second lower corner openings, and weighted means attached to each of the bottom ends of said cover sheet and protruding outwardly and extending a predetermined distance from each of said end plates, said weighted means when placed in corresponding ones of said lower corner openings on either or both sides of said end plates maintains said cover sheet closed, flat and wrinkle free on either or both sides of said table, said weighted means when removed from corresponding ones of said lower corner openings on either or both sides of said end plates allows said cover sheet to be opened on either side of said table for ready access to the interior of said table.

5. A utility table according to claim 1 for attaching to a fence railing in which said base member includes a pair of support means on each side of the backside of said base member, a pair of lea support means mounted in said pair of support means rotatable from a flat position on the backside of said base member to an open position, wrap means for tightly wrapping said pair of leg support means against vertical members of said railing to prevent any possibility of said base member tilting, and multiple means on the underside of said base member to sandwich said base member to the top of said railing to therby prevent lateral sliding of said base member.

6. A utility table according to claim 1 for use as a mobile table in which said base member includes a pair of support means on each end of the underside thereof, a pair of leg supports means mounted in said pair of support means for maintaining said base member a predetermined distance from a floor surface, and stabilizing means connected between one end of the backside of said base member and the bottom side of one of said leg supports means which connects at the other end of said base member to thereby stabilize said table in an upright position.

7. A utility table according to claim 1 for use as a mobile table in which said base member includes a pair of support means on each end of the backside of said base member, a pair of leg supports mounted in said pair of support means in an open position for maintaining said base member a predetermined distance from a floor surface, stabilizing means connected between one end of the backside of said base member and the bottom side of one of said leg supports means, which comes at the other end of said base member to thereby stabilize said table in an upright position, wheel means connected to the leg support means at said one end of said base member for allowing said utility table to operate as a mobile table, and hand bar means connected at the underside of said other end of said base member and rotatable to an open position extending out from said base member to allow a hand held movement of said table by said wheel means.

8. An enclosed utility table for easy access to either side of said. table comprising, an elongated rectangular base member having parallel sides and parallel ends, a pair of parallel stationary end plates secured to the parallel ends of said base member having corresponding first and second upper corner openings and first and second lower corner openings, a first support member corresponding to one side of said base member being maintained in said corresponding first upper corner openings of said end plates, a second support member corresponding to the other side of said base member being maintained in said corresponding second uppper corner openings of said end plates, said support members protruding outwardly and extending a predetermined distance from each of said end plates, a thin cover sheet centered over said support members and overlapping said end plates having bottom ends thereof extending to the parallel sides of said base member to thereby allow said bottoms of said cover sheet to be moved between open and closed positions, a third support member positioned on said cover sheet and centered between said first and second support members, said third support means protruding outwardly and extending a predetermined distance from each of said end plates, a pair of locking means each positioned on the outwardly extending portions of said first, second and third support means to maintain said cover sheet in a fixed position thereby allowing said cover sheet to be opened on either side without any shifting of the cover sheet, said support means together with said locking means forming a cradle to support either or both sides of said cover sheet when either or both sides of said cover sheet are opened for access to the interior of said table, and weighted means attached to each of the bottom ends of said cover sheet and protruding outwardly and extending a predetermined distance from each of said end plates, said weighted means when contained in either or both of the corresponding ones of said first and second lower corner openings maintains said cover sheet closed, flat and wrinkle free on either or both sides of said table, said weighted means when not contained in either or both of the corresponding ones of said first and second lower corner openings allows said cover sheet to be opened on either or both sides of said table for ready access to the interior of said table.

* * * * *